US012222188B2

(12) United States Patent
Serbu

(10) Patent No.: US 12,222,188 B2
(45) Date of Patent: Feb. 11, 2025

(54) FIREARM HANDGUARD

(71) Applicant: Mark Serbu, Tampa, FL (US)

(72) Inventor: Mark Serbu, Tampa, FL (US)

(73) Assignee: Serbu Firearms, Inc., Tampa, FL (US)

( * ) Notice: Subject to any disclaimer, the term of this patent is extended or adjusted under 35 U.S.C. 154(b) by 294 days.

(21) Appl. No.: 17/950,843

(22) Filed: Sep. 22, 2022

(65) Prior Publication Data

US 2023/0017012 A1 Jan. 19, 2023

Related U.S. Application Data

(63) Continuation-in-part of application No. 17/147,981, filed on Jan. 13, 2021, now Pat. No. 11,674,775.

(60) Provisional application No. 62/962,694, filed on Jan. 17, 2020.

(51) Int. Cl.
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS

| | | | | |
|---|---|---|---|---|
| 2,717,465 | A | 9/1955 | Clark et al. | |
| 6,269,577 | B1 | 8/2001 | Hardy | |
| 8,091,265 | B1 | 1/2012 | Teetzel et al. | |
| 8,146,282 | B2 | 4/2012 | Cabahug et al. | |
| 8,429,845 | B1 | 4/2013 | Swan | |
| 8,516,731 | B2 * | 8/2013 | Cabahug | F41G 11/003 42/72 |
| 8,640,372 | B2 | 2/2014 | Hochstrate et al. | |
| 8,875,434 | B2 | 11/2014 | Michal et al. | |
| 9,200,867 | B1 | 12/2015 | Swan | |
| 10,274,283 | B1 | 4/2019 | Oglesby | |
| 10,386,148 | B1 | 8/2019 | Handrick | |
| 11,105,571 | B2 * | 8/2021 | Noonan | F41C 23/16 |
| 2007/0017139 | A1 | 1/2007 | Larue | |
| 2007/0271832 | A1 | 11/2007 | Griffin | |
| 2012/0096755 | A1 | 4/2012 | Griffin | |
| 2012/0266514 | A1 | 10/2012 | Michal et al. | |
| 2014/0000142 | A1 | 1/2014 | Patel | |
| 2014/0076146 | A1 | 3/2014 | Gomez | |
| 2014/0223794 | A1 | 8/2014 | Brown | |
| 2015/0253090 | A1 | 9/2015 | Kirchhoff | |

(Continued)

OTHER PUBLICATIONS

Non-Final Office Action for U.S. Appl. No. 17/147,981, dated Jun. 15, 2022.

(Continued)

*Primary Examiner* — Michelle Clement
(74) *Attorney, Agent, or Firm* — Foley & Lardner LLP

(57) ABSTRACT

A handguard assembly for a firearm includes a body member having a first end, a second end, and an inner volume. The inner volume receives a barrel of the firearm. The first member is fixedly coupled with the body member at the first end. The handguard assembly also includes multiple elongated members that extend through the inner volume of the body member and fixedly couple with the first member at the first end of the body member. The elongated members extend through the second end of the body member and couple with a receiver of the firearm.

20 Claims, 14 Drawing Sheets

(56) References Cited

U.S. PATENT DOCUMENTS

| | | | | |
|---|---|---|---|---|
| 2015/0345896 | A1 | 12/2015 | Michal et al. | |
| 2018/0010881 | A1 | 1/2018 | Garst et al. | |
| 2019/0277597 | A1 | 9/2019 | Benjamin et al. | |
| 2020/0232734 | A1 | 7/2020 | Herring et al. | |
| 2022/0146219 | A1* | 5/2022 | Noonan | F41A 3/66 |

OTHER PUBLICATIONS

Final Office Action for U.S. Appl. No. 17/147,981, dated Nov. 25, 2022.

* cited by examiner

FIREARM HANDGUARD

CROSS-REFERENCE TO RELATED PATENT APPLICATION

This application is a continuation-in-part of U.S. application Ser. No. 17/147,981, filed Jan. 13, 2021, which claims the benefit of and priority to U.S. Provisional Application No. 62/962,694, filed Jan. 17, 2020, the entire disclosures of which are herein incorporated by reference.

BACKGROUND

The present disclosure relates to firearms. More particularly, the present disclosure relates to handguards for firearms.

SUMMARY

One implementation of the present disclosure provides for a handguard assembly for a firearm. The handguard assembly includes a body member having a first end, a second end, and an inner volume. The body member defines a surface for a user to grasp the firearm. The inner volume receives a barrel of the firearm. The handguard assembly includes a first member that is fixedly coupled with the body member at the first end. The handguard assembly also includes multiple elongated members that extend through the inner volume of the body member and fixedly couple with the first member at the first end of the body member. The elongated members extend through the second end of the body member and couple with a receiver of the firearm.

Another implementation of the present disclosure provides for a firearm. The firearm includes a barrel, a receiver, and a handguard assembly. The handguard assembly includes a body member, a first member, and multiple elongated members. The body member has a first end, a second end, and an inner volume. The body member defines a portion for a user to grasp when using the firearm. The inner volume receives the barrel of the firearm. The first member is fixedly coupled with the body member at the first end. The elongated members extend through the inner volume of the body member and fixedly couple with the first member at the first end of the body member. The elongated members extend through the second end of the body member and couple with the receiver.

Another implementation of the present disclosure provides for a handguard assembly for a firearm. The handguard assembly includes a body member, and multiple spokes. The body member has a first end, a second end, and an inner volume. The body member defines a surface for a user to grasp the firearm. The inner volume is configured to receive a portion of the firearm. The spokes extend through the inner volume of the body member and fixedly couple with an end member at the first end and a receiver of the firearm at a second end. The spokes are loaded in tension to provide a compressive force through the body member between the first end and the second end.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
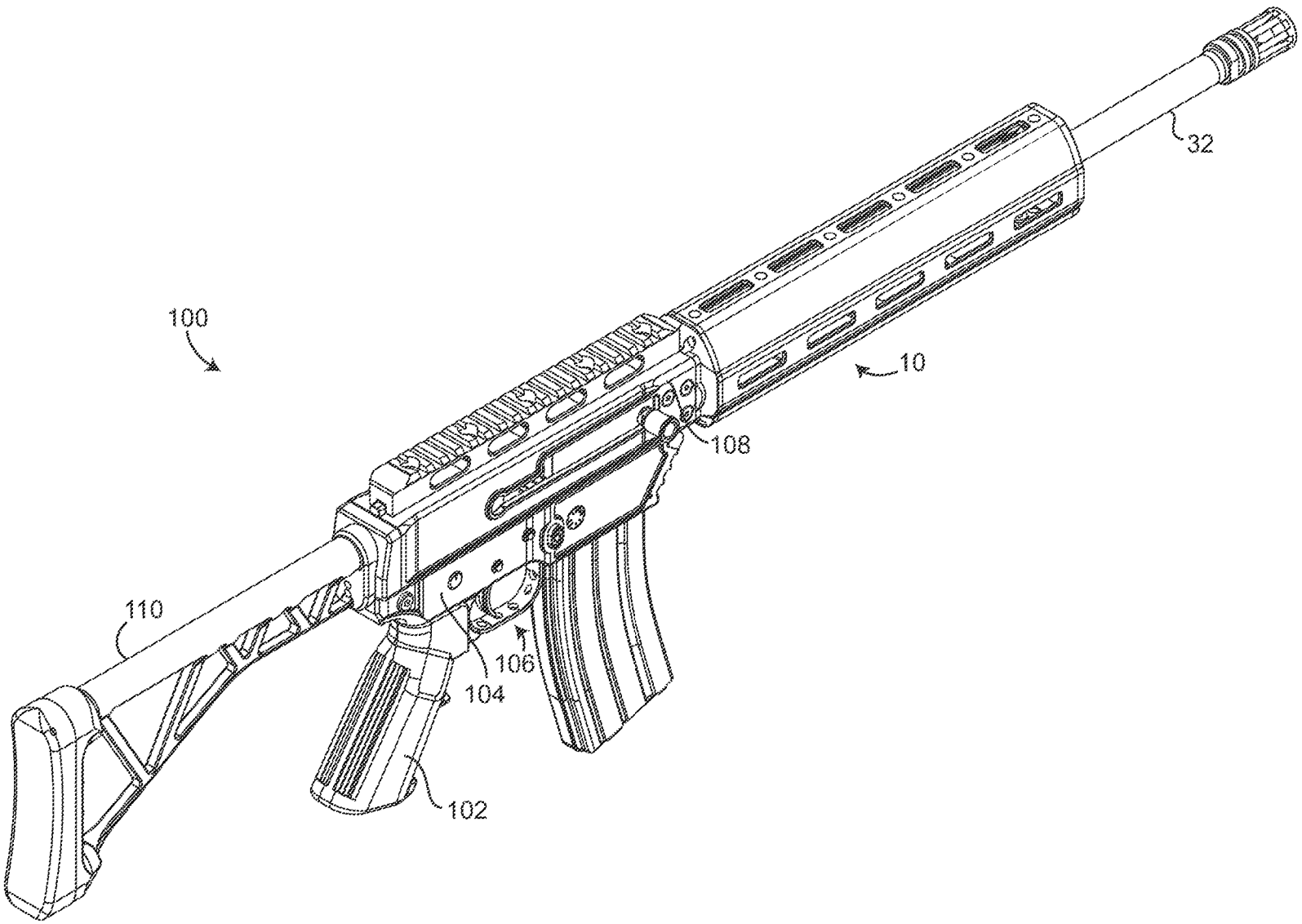
FIG. 1 is an isometric view of a firearm including a handguard, according to an example embodiment.
Figure 2:
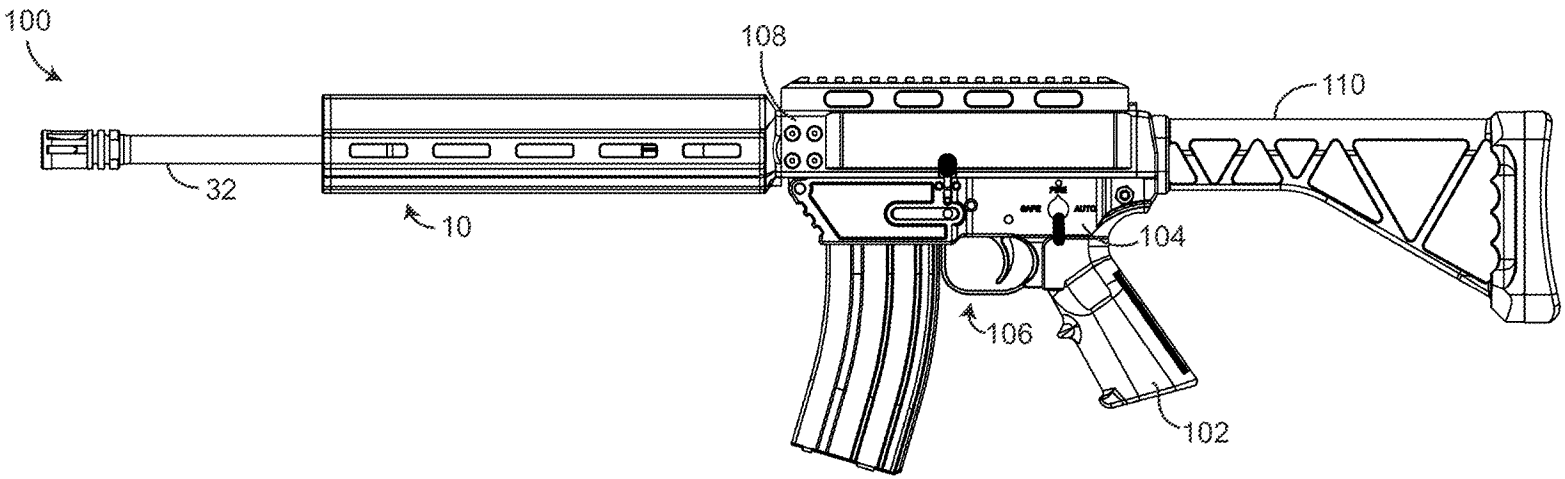
FIG. 2 is a side view of the firearm of FIG. 1.

Before turning to the figures, which illustrate the example embodiments in detail, it should be understood that the present disclosure is not limited to the details or methodology set forth in the description or illustrated in the figures. It should also be understood that the terminology used herein is for the purpose of description only and should not be regarded as limiting.

Overview

Referring generally to the figures, a handguard for a firearm includes a body member, a first end member, a second end member, and multiple elongated members or rods that extend through an inner volume of the body member. The body member and the rods may extend in a same direction such that the body member and the rods are parallel with each other. The first end member fixedly couples with the body member at a first end of the body member (an end proximate a receiver of the firearm). The second end member fixedly couples with the body member at a second end of the body member (an end distal a receiver of the firearm). The first end member and the second end member may include one or more openings, windows, apertures, etc., through which a barrel and/or gas-system of the firearm extend. The first end member may engage the barrel through an opening and an interior surface. For example, the interior surface may directly contact, abut, engage, be press-fit, be slip-fit, etc., with a corresponding portion of the barrel. In some embodiments, the barrel is free-floating within the handguard.

The rods can be fastened or otherwise fixedly coupled at opposite ends with the first end member and the second end member and may extend through the inner volume of the body member. The rods may facilitate reducing or eliminating an amount of load applied to the body member being transferred to the barrel. Transfer of load to the barrel can result in bending or deformation of the barrel and adversely affect accuracy of the firearm. The handguard may be a free-floating handguard.

In various conventional firearms, the handguards attach to a receiver of the firearm at an aft end, and to the barrel at the front end. Because of this arrangement, any force or load applied on the handguards (e.g., by a user, during operation of the firearm) may be transmitted to the barrel, causing it to bend slightly and cause a reduction in accuracy.

In many firearms it is desirable to have the handguard be free-floating and not rely on any support from or connection to the barrel in order to reduce a likelihood that the force or load at the handguards is transferred to the barrel. A free-floating handguard generally only attaches to the firearm at one surface, usually its aft end. This may require that the entire handguard either be made from one piece or is a weldment or assembly. A weldment requires that the handguard be made from materials which can be welded. Common materials for the handguard body can be extruded aluminum, bent-up or pressed aluminum or steel, plastic, carbon fiber, magnesium.

The handguard described herein is an assembly that is formed by fixedly coupling end caps to the ends of the handguard body, which (other than being hollow to allow the barrel, gas system, etc., to pass through it) can be of virtually any shape. The handguard body is encapsulated between the fore and aft end caps using any of, or any combination of rods, wires, cables, spokes, or any other elongated member that can be loaded in tension. The endcaps facilitate attaching of the rods, wires or spokes by holes (threaded or otherwise) or features which engage them by mating threads or features. Advantageously, using the rods may facilitate allowing the body member being manufactured from non-weldable materials if desired, and facilitates reducing or eliminating an amount of load transferred to the barrel through the body member. The rods may also provide additional structural support or strength for the body member.

Firearm

Referring to FIGS. 1-7, a firearm 100 is shown, according to an example embodiment. The firearm 100 can be a semi-automatic firearm (e.g., a semi-automatic rifle) or a fully-automatic firearm (e.g., a fully-automatic rifle). It should be understood that the firearm 100 can be any other style of firearm and the example shown in FIGS. 1-7 should not be understood to be limiting.

The firearm 100 includes a stock 110, a grip 102 (e.g., a pistol grip, a hand grip, etc.), a lower receiver 104, an upper receiver 108, a trigger assembly 106, and a barrel 32. The firearm 100 also includes a handguard 10 (e.g., a grasping portion, a sleeve portion, a grip, etc.) through which the barrel 32 extends. The firearm 100 may be operated by placing the stock 110 against a user's shoulder and through operation of a trigger of the trigger assembly 106. The handguard 10 may provide a surface for steadying and aiming the firearm 100 (e.g. being grasped with a user's hand). The firearm 100 can be an M-16 and/or an AR-15 rifle.

Firearm Handguard

Figure 8:
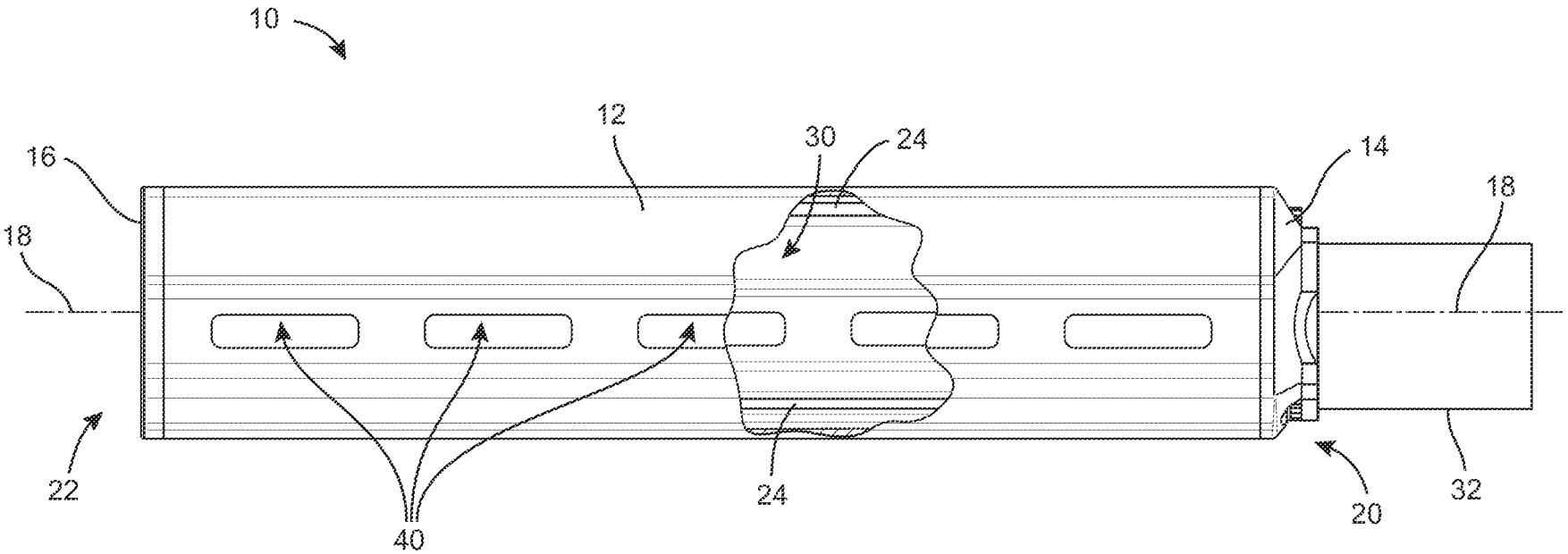
FIG. 8 is a side view of a handguard for use with the firearm of FIGS. 1-7, according to an example embodiment.

Referring particularly to FIG. 8, the handguard 10 (e.g., a grasping portion, a sleeve portion, a grip, etc.) for a firearm (e.g., the firearm 100 of FIGS. 1-7) is shown, according to an example embodiment. Handguard 10 can be configured for use with any type of firearm such as a semi-automatic firearm (e.g., a semi-automatic rifle), or a fully-automatic firearm. It should be understood that handguard 10 can be configured for use with any style of firearm (such as the firearm 100 shown in FIGS. 1-7) and the examples of a semi-automatic firearm or a fully-automatic firearm should not be understood to be limiting.

Handguard 10 may be an elongated hollow member including an inner volume 30 that extends through handguard 10. Handguard 10 includes a front end, a front portion, a forward portion, a fore end, etc. shown as first end 20, and a rear end, a back end, a back portion, a rear portion, an aft end, etc., shown as second end 22. Handguard 10 includes a body member 12 (e.g., a main member, a sidewall member, a tubular member, a hollow member, an elongated member, a shell, etc.), a first end member 14 (e.g., an end cap, a hollow member, a structural member, etc.), and a second end member 16 (e.g., an end cap, a hollow member, a structural member, etc.). First end member 14 may be positioned at first end 20 and may be fixedly coupled, attached, secured, fastened, etc., with first end 20 of body member 12. Likewise, second end member may be positioned at second end 22 and may be fixedly coupled, attached, secured, fastened, etc., with second end 22 of body member 12. First end member 14 can be configured to fixedly couple (e.g., removably attach, interlock, be fastened with, etc.), with a receiver or other portion of the firearm. Body member 12 may include multiple openings 40 on one or more sides that extend through a wall thickness or at least partially through the wall thickness of body member 12. Openings 40 may facilitate reducing a weight of body member 12 and improved heat dissipation. Openings 40 can be positioned and sized on body member 12 according to a standard rail interface system. For example, openings 40 can facilitate mounting of accessories on handguard 10 such as bipods, optics, scopes, etc., which may include fasteners, interlocking portions, etc., that extend into openings 40. As shown, body member 12 may have a generally rectangular cross-sectional shape. In other embodiments, body member 12 may have an elliptical, irregular, square, non-uniform, circular, etc., cross-sectional shape. In some embodiments, a cross-sectional shape of body member 12 varies or changes across a length of body member 12.

First end member 14 may have a cross-sectional shape that corresponds to the cross-sectional shape of body member 12 or the cross-sectional shape of body member 12 at first end 20. Likewise, second end member 16 can have a cross-sectional shape that corresponds to the cross-sectional shape of body member 12 or the cross-sectional shape of body member 12 at second end 22. First end member 14 and second end member 16 may be configured to interlock with body member 12 at first end 20 and second end 22 of body member 12, respectively.

A longitudinal axis 18 extends through a center of handguard 10 or a center or body member 12. Longitudinal axis 18 may define a longitudinal direction. Handguard 10 also includes rods 24 (e.g., rods, elongated members, cylindrical members, wires, thin members, spokes, cables, tensile members, etc.) that extend through inner volume 30 of body member 12. Rods 24 can extend in a direction that is parallel or substantially parallel with longitudinal axis 18 of body member 12. Rods 24 may be or function similarly to bicycle spokes and can facilitate reducing an amount of load that is transferred to a barrel 32 of the firearm. Loads that are transferred to barrel 32 of the firearm can adversely affect an accuracy of the firearm. It should be understood that the rods 24 described herein may be any of rods, elongated members, cylindrical members, wires, thin members, spokes, cables, tensile members, etc., or any combination thereof. It should be understood that the term "elongated members" as used herein may refer to any of, or any combination of, rods, cylindrical members, wires, thin members, spokes, cables, tensile members, etc.

In various conventional firearms, handguards may be fixedly coupled with the barrel of the firearm at their fore or front ends and fixedly coupled with the firearm receiver at their aft or rearwards ends. However, such a configuration may result in any force applied to the handguard being transferred or transmitted to the barrel, which may cause the barrel to bend slightly and can adversely affect an accuracy of the firearm.

Figure 9:
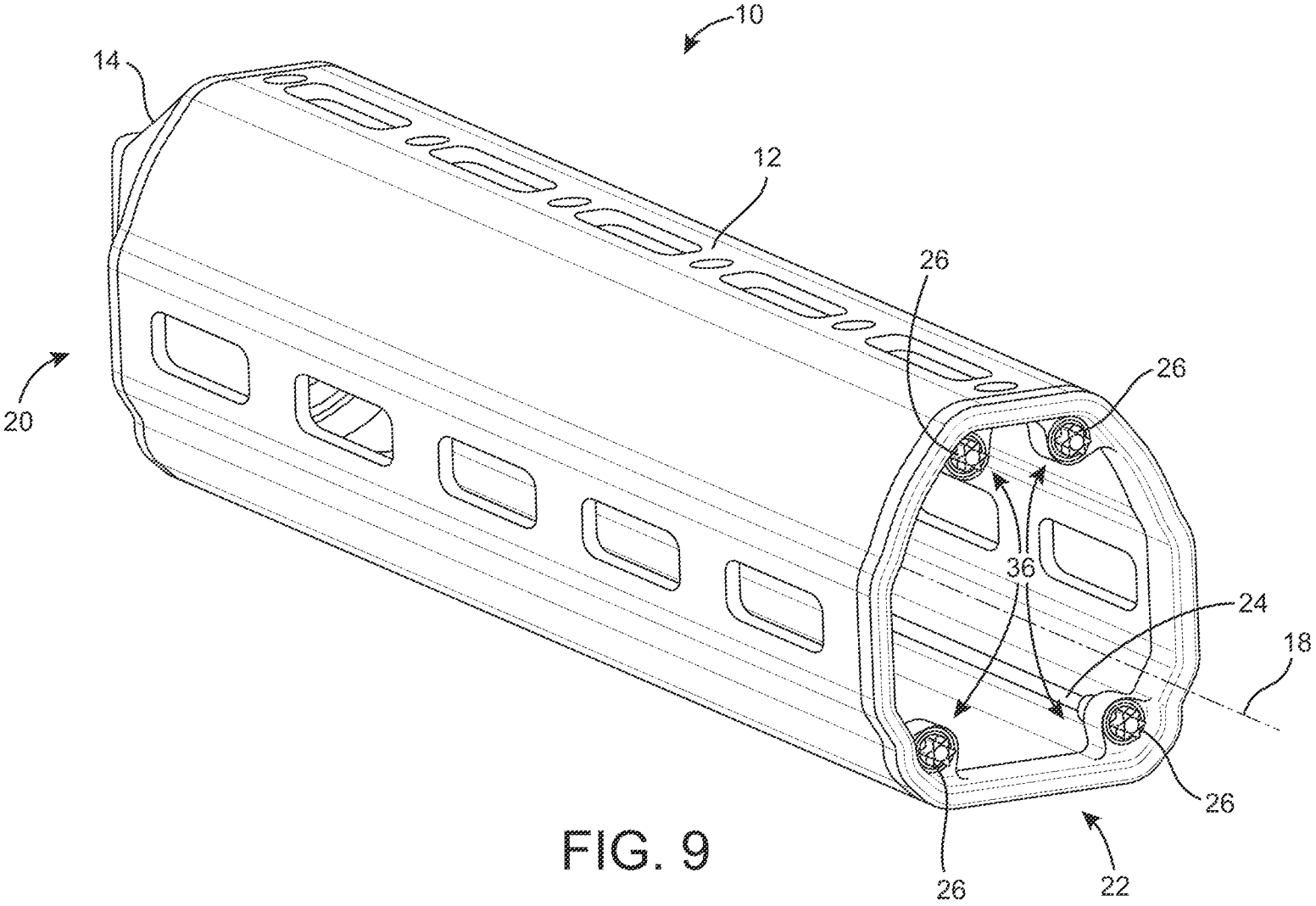
FIG. 9 is a perspective view of the handguard of FIG. 8.

Referring particularly to FIG. 9, rods 24 may extend along substantially an entire longitudinal length of body member 12 through inner volume 30. Rods 24 may extend between first end member 14 and second end member 16. In the example embodiment shown in FIGS. 1-4, rods 24 extend from first end member 14 to second end member 16 and are each fixedly coupled with first end member 14 at a first or proximate end and are fixedly coupled with second end member 16 at a second or distal end. Rods 24 may extend through inner volume 30 of body member 12 proximate or adjacent to an interior surface of body member 12. In the example embodiment shown in FIGS. 1-4, four rods 24 are used, which extend proximate to four corner portions of body member 12. In other embodiments, more or less than four rods 24 are used, each of which may extend longitudinally through inner volume 30. In some embodiments, rods 24 are positioned to extend along the interior surface of body member 12, or are partially enclosed within a corresponding track, groove, channel, recess, etc., of body member 12. Rods 24 may also be integrated or at least partially positioned within a sidewall of body member 12. In other embodiments, rods 24 extend longitudinally along or proximate an exterior surface of body member 12.

Referring still to FIG. 9, rods 24 can be fixedly coupled, attached, fastened, secured, etc., with second end member 16 at second end 22 of handguard 10. Rods 24 may be fixedly coupled with fasteners 26 that are positioned at corresponding attachment portions 36 of second end member 16. Fasteners 26 can include a central opening, an aperture, a hole, etc., configured to receive a corresponding end of rods 24. Attachment portions 36 can each include an opening, aperture, hole, bore, cavity, etc., through which rods 24 extend. Attachment portions 36 can also include threads configured to threadingly couple with corresponding threads of fasteners 26. In some embodiments, a tensile load on each of rods 24 can be independently adjusted by adjustment or fasteners 26 (e.g., by tightening or loosening fasteners 26). For example, rotating fasteners 26 clockwise or counterclockwise (depending on a direction of the threads of fasteners 26) may increase or decrease a tensile load applied to rods 24 between first end member 14 and second end member 16.

Figure 3:
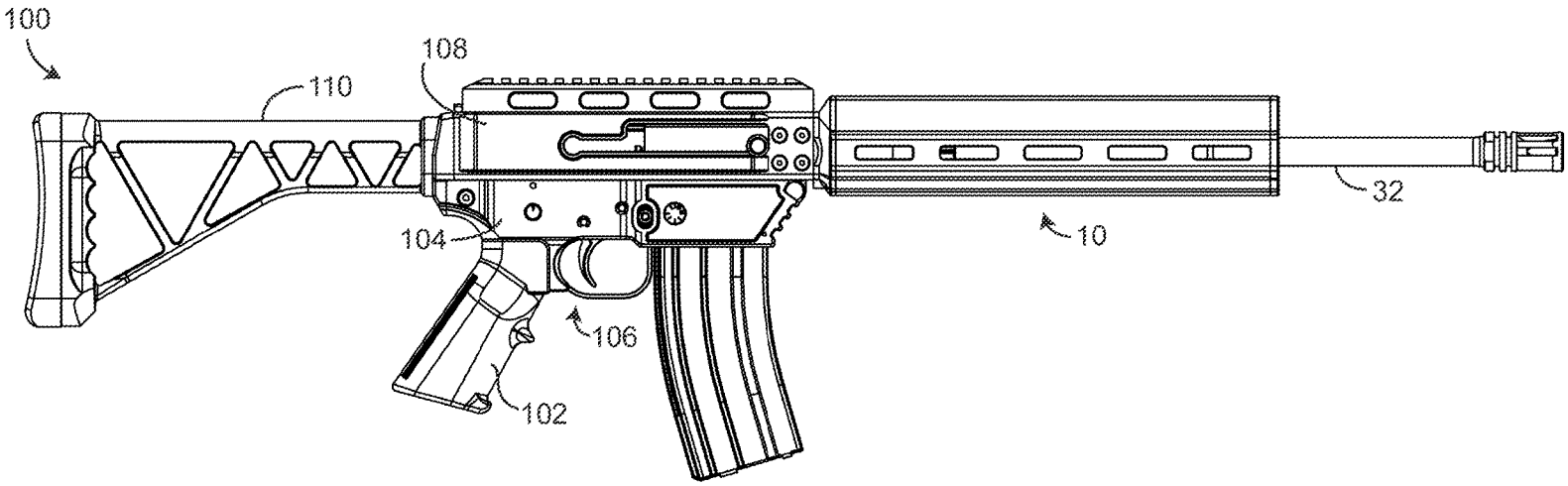
FIG. 3 is a side view of the firearm of FIG. 1.
Figure 4:
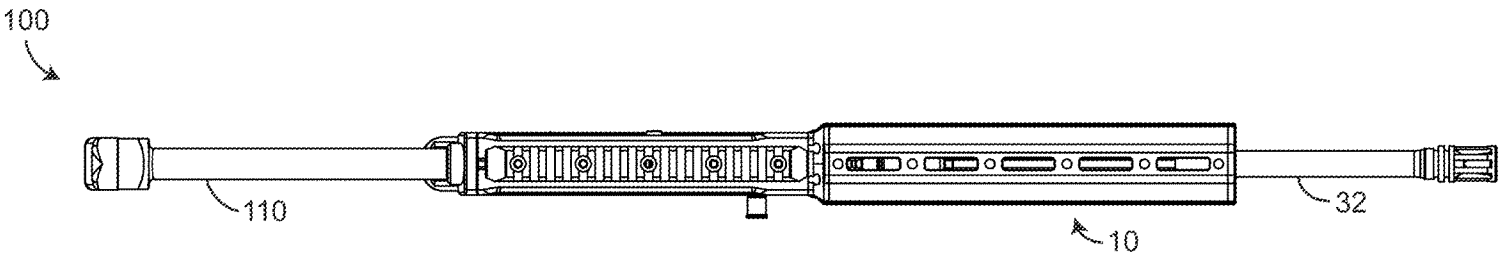
FIG. 4 is a top view of the firearm of FIG. 1.
Figure 5:
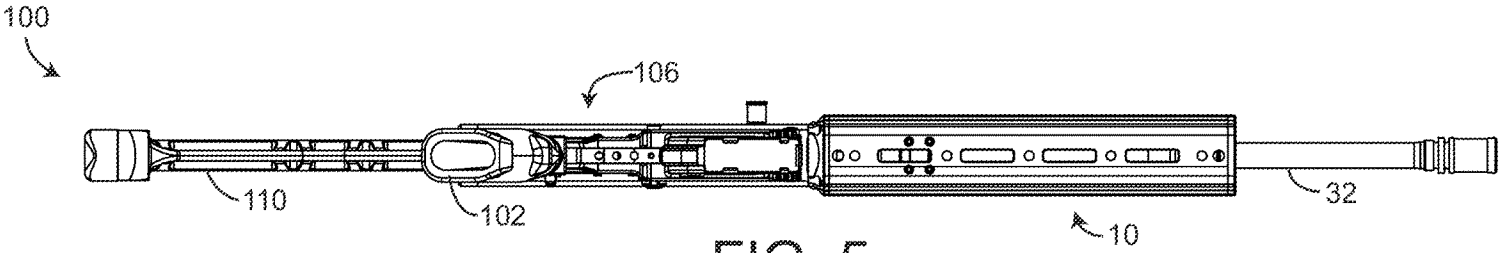
FIG. 5 is a bottom view of the firearm of FIG. 1.
Figure 7:
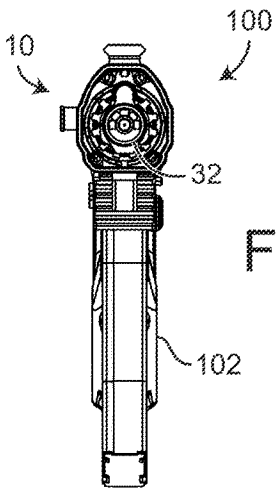
FIG. 7 is a front view of the firearm of FIG. 1.
Figure 6:
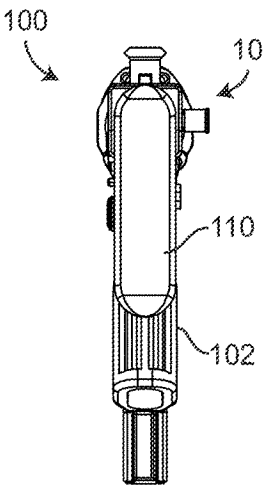
FIG. 6 is a rear view of the firearm of FIG. 1.
Figure 10:
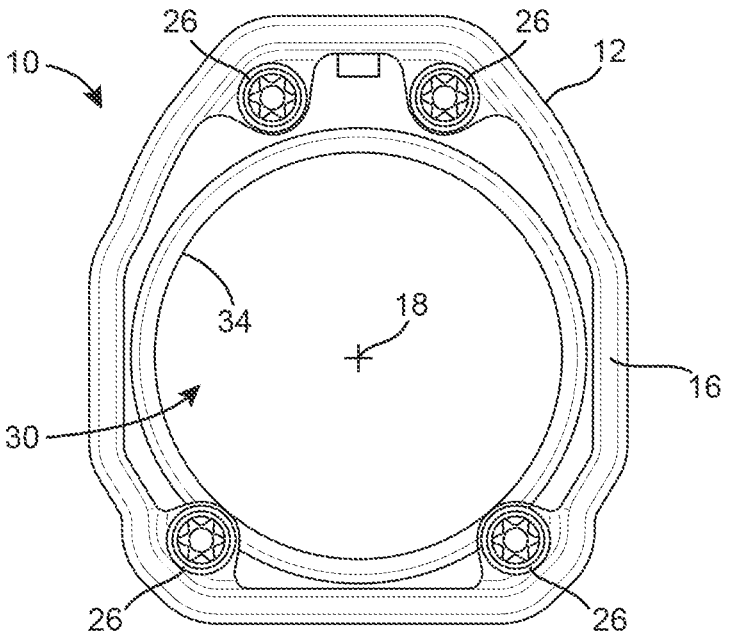
FIG. 10 is a from view of the handguard of FIG. 8.
Figure 11:
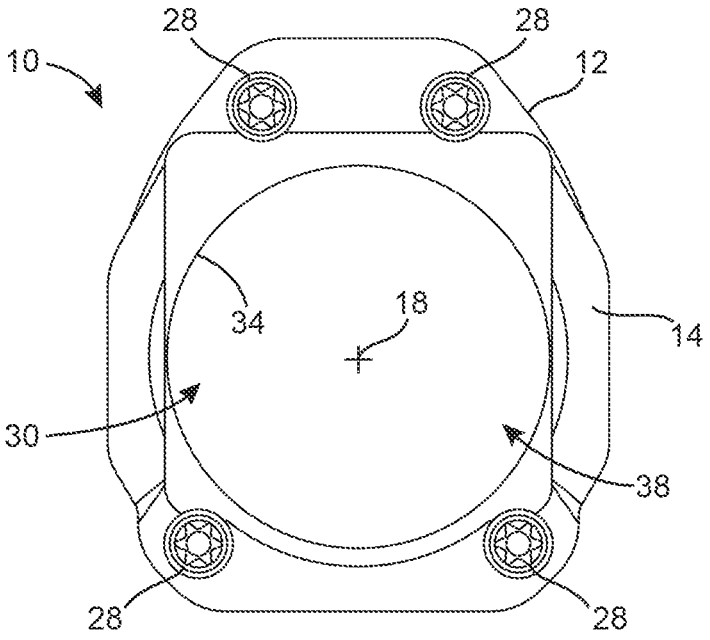
FIG. 11 is a rear view of the handguard of FIG. 8.

Referring particularly to FIGS. 10 and 11, respectively, a front view and a rear view of handguard 10 are shown. Rods 24 are fixedly coupled with first end member 14 (as shown in FIG. 4) at their first ends and are fixedly coupled with second end member 16 (as shown in FIG. 3) at their second ends.

Referring particularly to FIG. 11, rods 24 are fixedly coupled with first end member 14 through fasteners 28. Fasteners 28 may be the same as or similar to fasteners 26 at second end member 16. Fasteners 28 may include an opening, aperture, receiving portion, bore, window, etc., configured to receive an end of a corresponding rod 24. Fasteners 28 may also be adjustable to increase or decrease a tensile load applied to rods 24 (e.g., independently adjustable).

First end member 14 can include a radially inwards surface, an inner periphery, an interior surface, an inwards facing surface, etc., shown as inner surface 34. Inner surface 34 may be an interior surface of a bore, an opening, a window, an aperture, etc., shown as aperture 38. Aperture 38 may be configured to receive barrel 32 therethrough. An inner diameter of aperture 38 may be substantially equal to an outer diameter of a corresponding portion of barrel 32. Inner surface 34 can be configured to engage, directly contact, etc., an exterior surface of the corresponding portion of barrel 32.

It should be understood that while first end member 14 and second end member 16 are shown having a specific shape, first end member 14 and second end member 16 can have any shape, provided first end member 14 and second end member 16 include an opening, inner volume, window, aperture, etc., through which barrel 32 and various components of a gas-system of the firearm can extend (e.g., if the firearm includes a gas-system). Handguard 10 may also be configured for use with firearms that do not include a gas-system such as a bolt-action firearm, a lever action firearm, etc., or any other type of firearm.

Referring again to FIGS. 8-11, handguard 10 includes rods 24 that extend between first end member 14 and second end member 16 and are fixedly coupled at opposite ends through fasteners 26 and fasteners 28. Fasteners 26 and fasteners 28 may be threaded nuts, rivets, or any other type of fasteners. Handguard 10 may be manufactured from any steel, aluminum, composite, plastic, etc., material. Handguard 10 may fixedly couple or engage barrel 32 at only one end (e.g., at first end 20 through first end member 14). Handguard 10 can be fixedly coupled with a receiver (e.g., the upper receiver 108) of the firearm at a same end that engages barrel 32. In other embodiments, handguard 10 can fixedly couple with or engage barrel 32 at both ends or at a position between first end 20 and second end 22.

Referring to FIGS. 8-11, in another embodiment the handguard 10 is coupled directly with the firearm 100 directly using the rods 24 (e.g., without using the second end member 16 and/or the first end member 14). In another embodiment, the handguard 10 includes both the body member 12 and the second end member 16 (e.g., a forward end cap) without using the first end member 14. In such a configuration, the handguard 10 couples with the firearm 100 (e.g., with the upper receiver 108) through the rods 24 that extend out of the first end 20 of the body member 12. In some embodiments, the handguard 10 includes the body member 12, the rods 24, and one or both of the first end member 14 and the second end member 16 or neither. For example, the rods 24 may couple with a portion of the body member 12 at opposite ends instead of coupling with the first end member 14 and the second end member 16. The handguard may include (1) the body member 12, the first end member 14, the second end member 16, and the rods 24, (2) the body member 12, the first end member 14, and the rods 24, (3) the body member 12, the second end member 16, and the rods 24, or (4) the body member 12 and the rods 24. In any of such configurations, the rods 24 may fixedly couple with a corresponding portion of the body member 12 instead of the first end member 14 or the second end member 16. For configurations where the first end member 14 is not used, the rods 24 can directly couple with the firearm 100 (e.g., the upper receiver 108).

Advantageously, handguard 10 may include rods 24 which provide structural support for body member 12 between first end member 14 and second end member 16. In some embodiments, rods 24 are loaded in tension, thereby compressing body member 12 between first end member 14 and second end member 16. Rods 24 may facilitate reducing an amount of load applied to body member 12 (e.g., by a user of the firearm) being transferred to barrel 32 which may cause barrel 32 to deform or bend and adversely affect accuracy of the firearm. Rods 24 in combination with engaging barrel 32 at first end member 14 may further facilitate reducing the loads applied at body member 12 being transferred to barrel 32. Advantageously, rods 24 and engaging barrel 32 at first end member 14 can facilitate reducing loads to barrel 32, thereby decreasing a likelihood that loads are transferred to barrel 32 (which may compromise an accuracy of the firearm).

As described herein, handguard 10 is an assembly including body member 12, first end member 14, second end member 16, rods 24, and fasteners 26 and 28. Advantageously, using rods 24 allows body member 12 to be a free-floating handguard that does not require a weldable material. Body member 12 may be manufactured from a lightweight composite, a polymer, a plastic, aluminum, steel, etc., while rods 24 may provide additional structural strength for body member 12 and reduce an amount or a likelihood that loads or forces applied at body member 12 are transferred to barrel 32.

Figure 12:
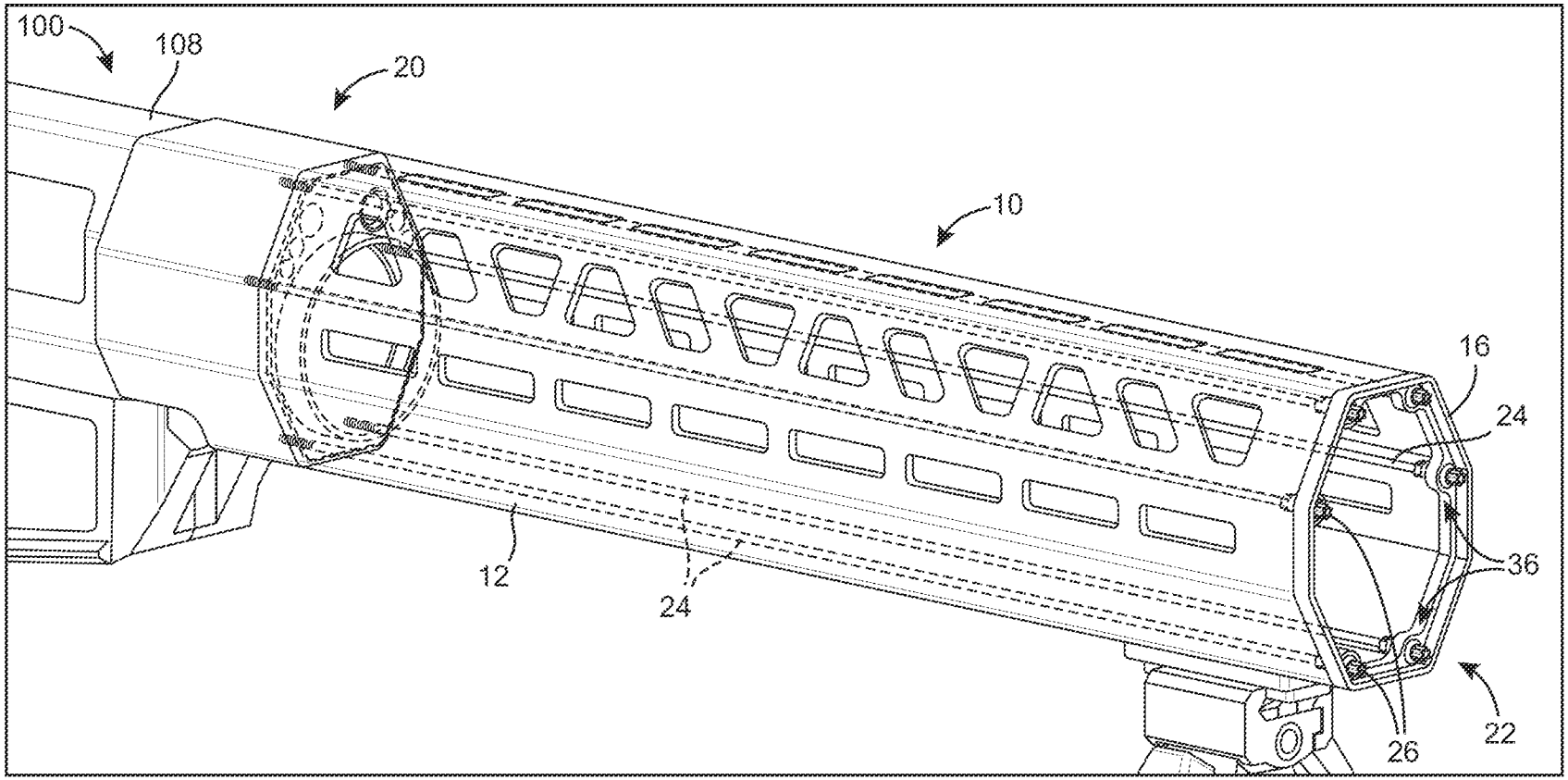
FIG. 12 is a perspective view of a handguard for use with the firearm of FIGS. 1-7, according to an example embodiment.
Figure 13:
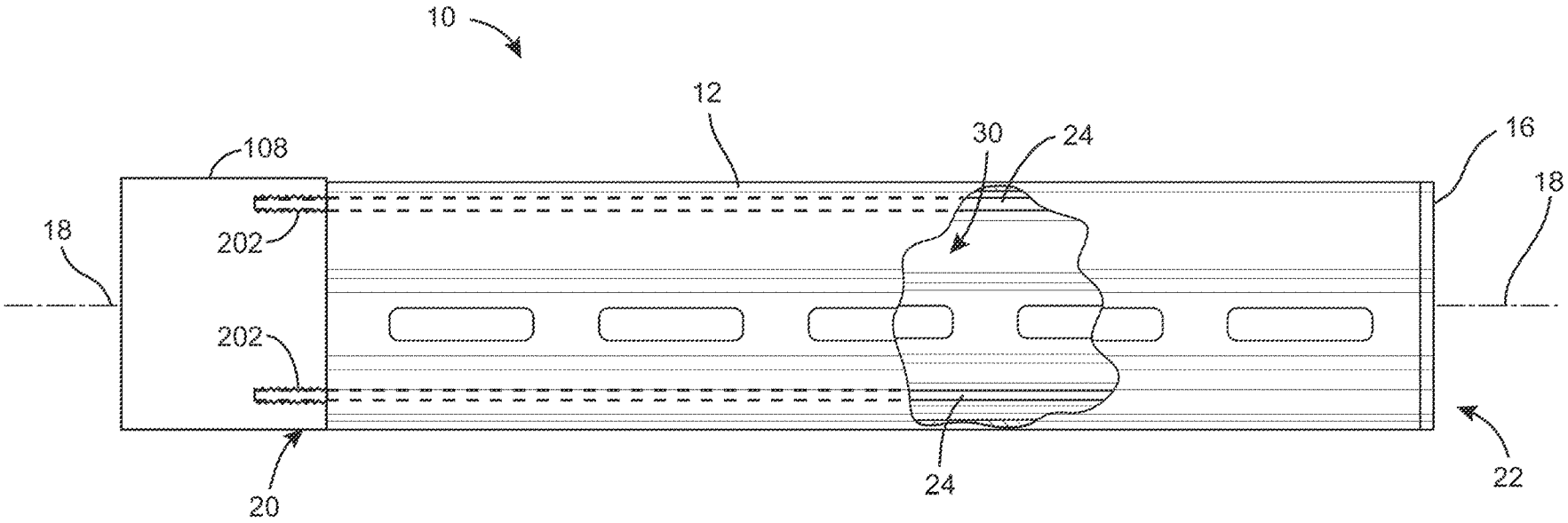
FIG. 13 is a side view of the handguard of FIG. 12.

Referring to FIGS. 12-13, the handguard 10 does not include the first end member 14, according to some embodiments. The handguard 10 may be directly coupled with the upper receiver 108 through the rods 24. For example, the rods 24 may extend from the first end 20 of the handguard 10, and thread into one or more threaded holes 202 of a proximate portion of the upper receiver 108. In some embodiments, the rods 24 extend through a bulkhead of the handguard 10 and thread into a structural portion of the upper receiver 108. The handguard 10 may directly contact or abut the upper receiver 108, or may contact an intermediate member through which the rods 24 extend.

Figure 14:
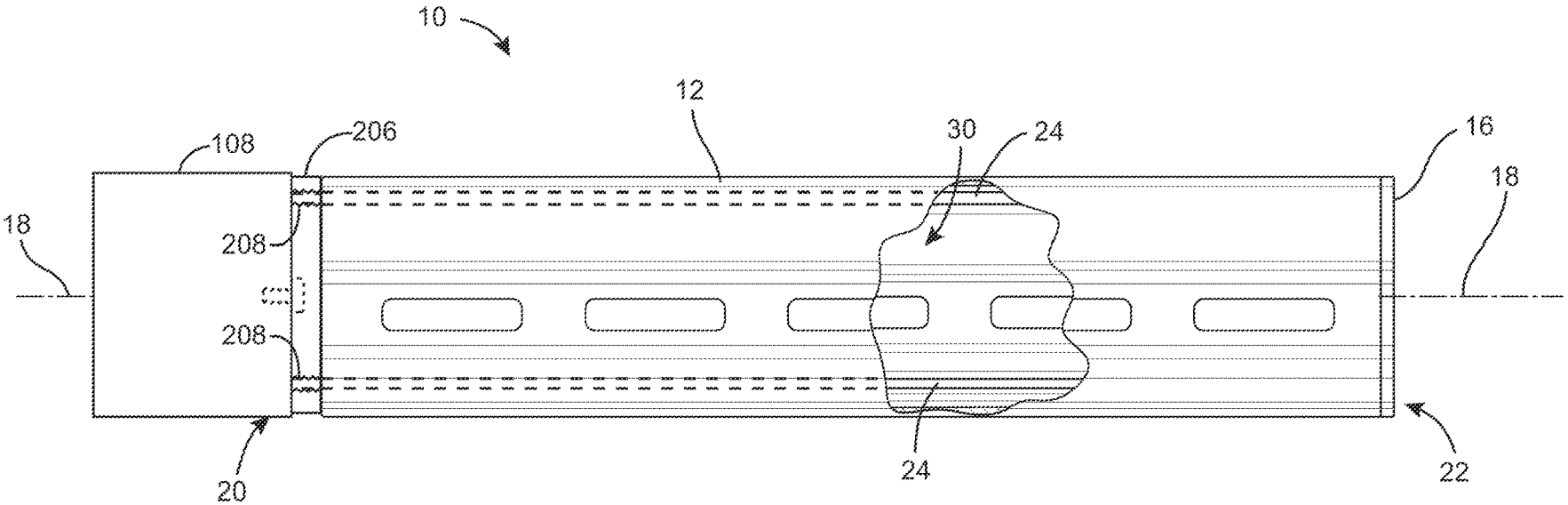
FIG. 14 is a side view of a handguard for use with the firearm of FIGS. 1-7, according to an example embodiment.

Referring to FIG. 14, the handguard 10 can be fixedly coupled with the upper receiver 108 through an intermediate member 206. In some embodiments, the intermediate member 206 is an end member that includes threaded openings 208 with which a threaded end portion of the rods 24 can threadingly couple. The intermediate member 206 is attached, secured, fixed, etc., with the upper receiver 108 by one or more fasteners, an adhesive, an interlocking portion, clamping members, hooks, etc.

Figure 15:
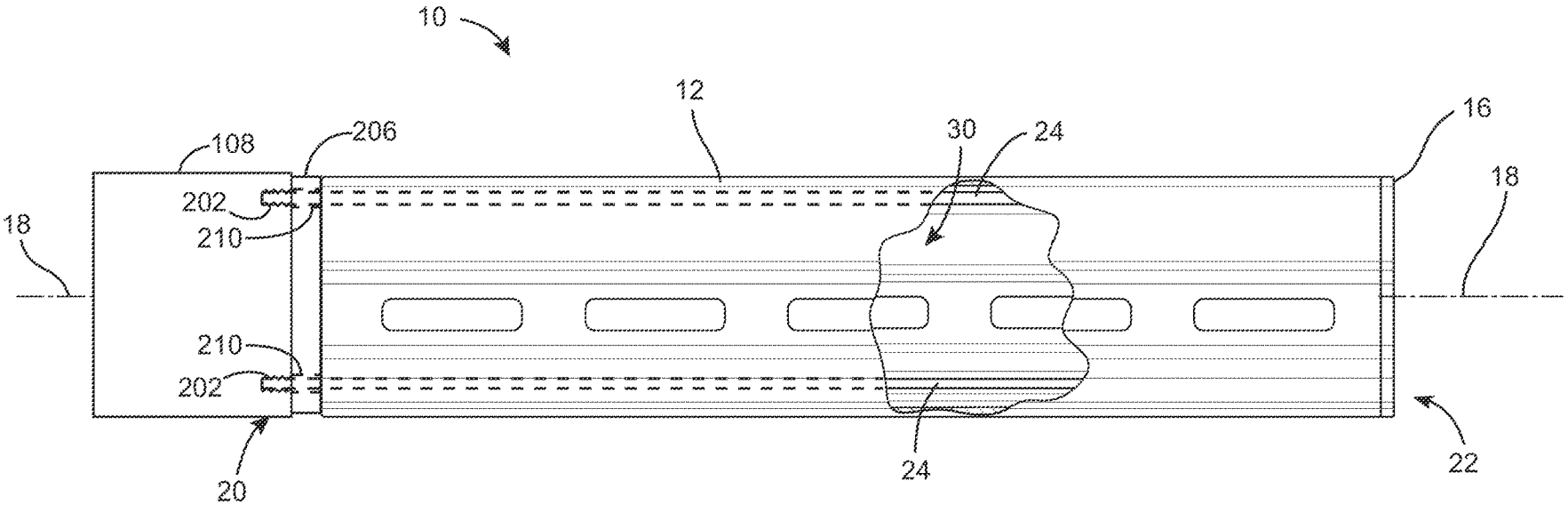
FIG. 15 is a side view of a handguard for use with the firearm of FIGS. 1-7, according to an example embodiment.

Referring to FIG. 15, the intermediate member 206 can, according to another embodiment, include through holes 210 so that the rods 24 may pass through the holes 210 of the intermediate member 206 and thread into the threaded holes 202 of the proximate portion of the upper receiver 108. In some embodiments, the intermediate member 206 is held in place between the upper receiver 108 and the body member 12 of the handguard 10. In various embodiments, the intermediate member 206 is attached, secured, fixed, etc., with the upper receiver 108 by one or more fasteners, an adhesive, an interlocking portions, clamping members, hooks, etc.

Figure 16:
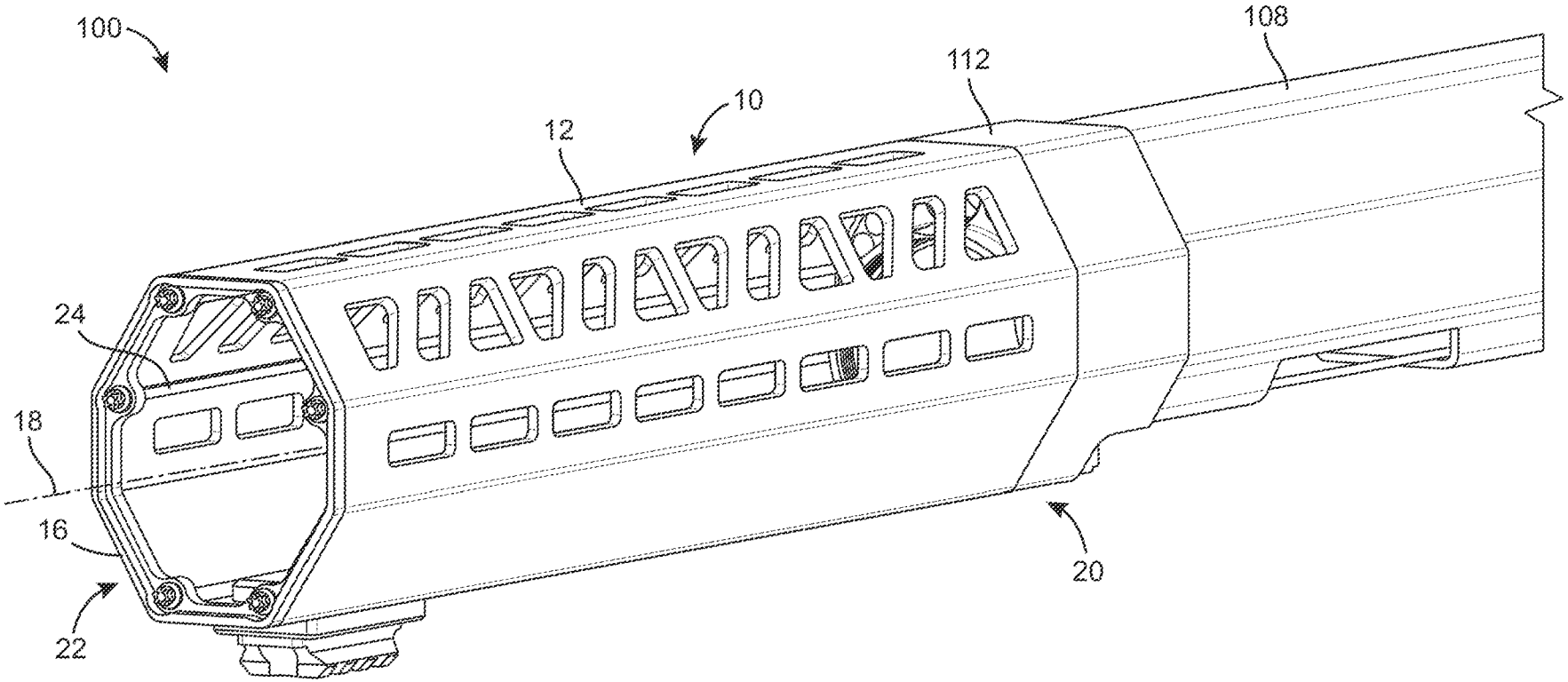
FIG. 16 is a perspective view of the handguard of FIG. 12.
Figure 17:
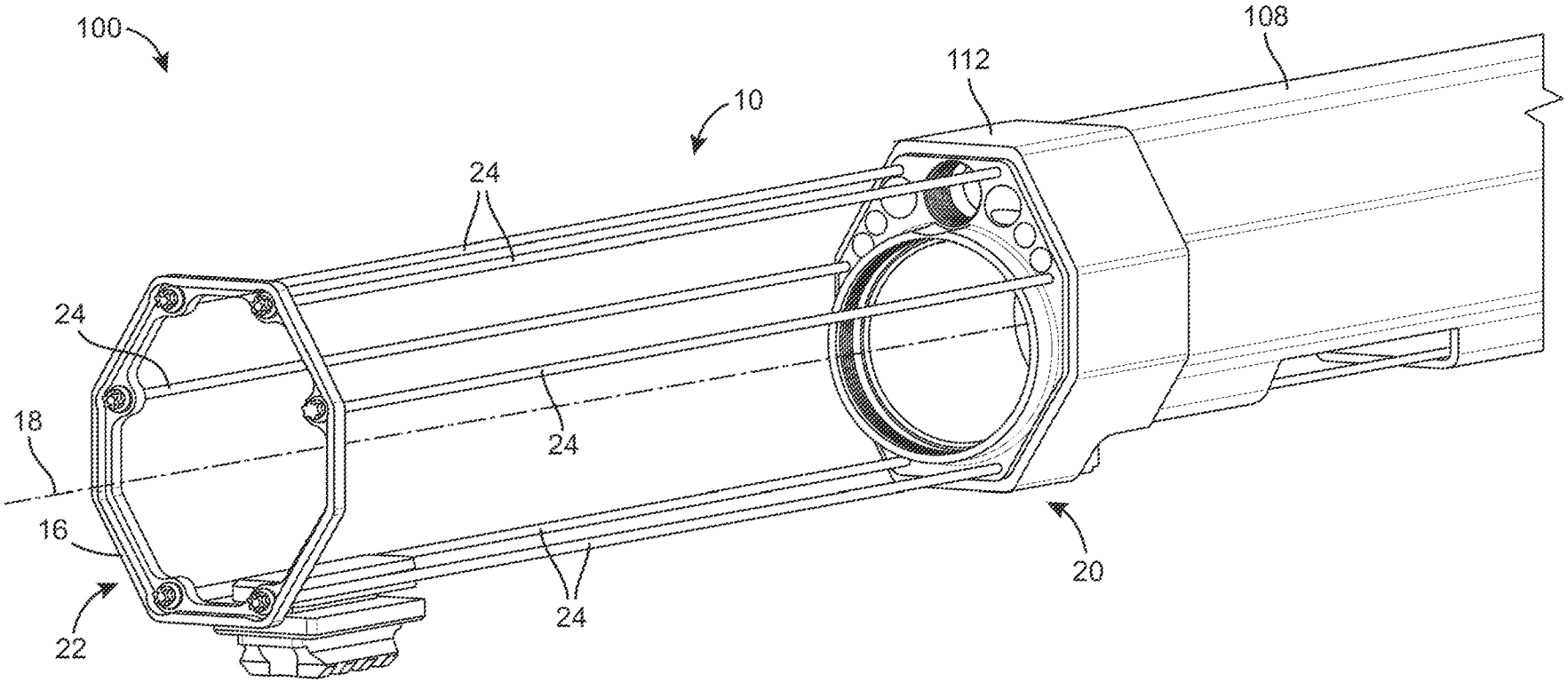
FIG. 17 is a perspective view of a portion of the handguard of FIG. 12.
Figure 18:
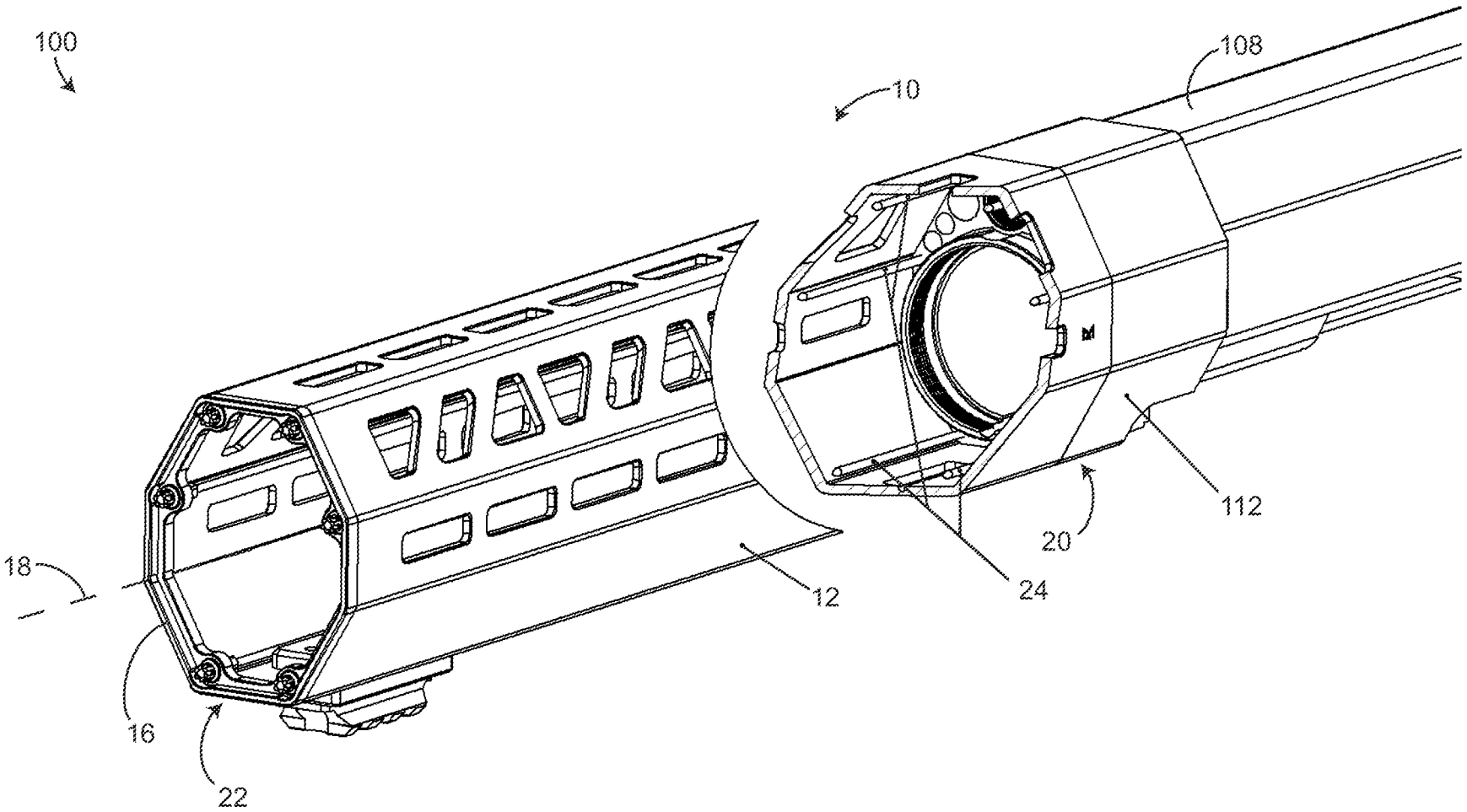
FIG. 18 is another perspective view of the handguard of FIG. 12 with a cutout section.

Referring to FIGS. 16-18, the handguard 10 is shown, according to another embodiment. The rods 24 extend from the second end member 16 to the receiver 108 similarly to the embodiments of the handguard 10 as described in greater detail above with reference to FIGS. 8-15. However, the handguard 10 does not include the first end member 14 at the first end 20. The rods 24 instead couple directly with a trunnion 112 of the upper receiver 108. The trunnion 112 may be fixedly coupled, fastened, interlocked, friction or press fit, etc., with the upper receiver 108 and may include one or more openings and threaded interior surfaces positioned about the trunnion 112 and configured receive the rods 24 and fixedly couple the rods 24 with the trunnion 112. In some embodiments, the trunnion 112 includes an internal structure that is configured to receive the barrel 32.

Figure 19:
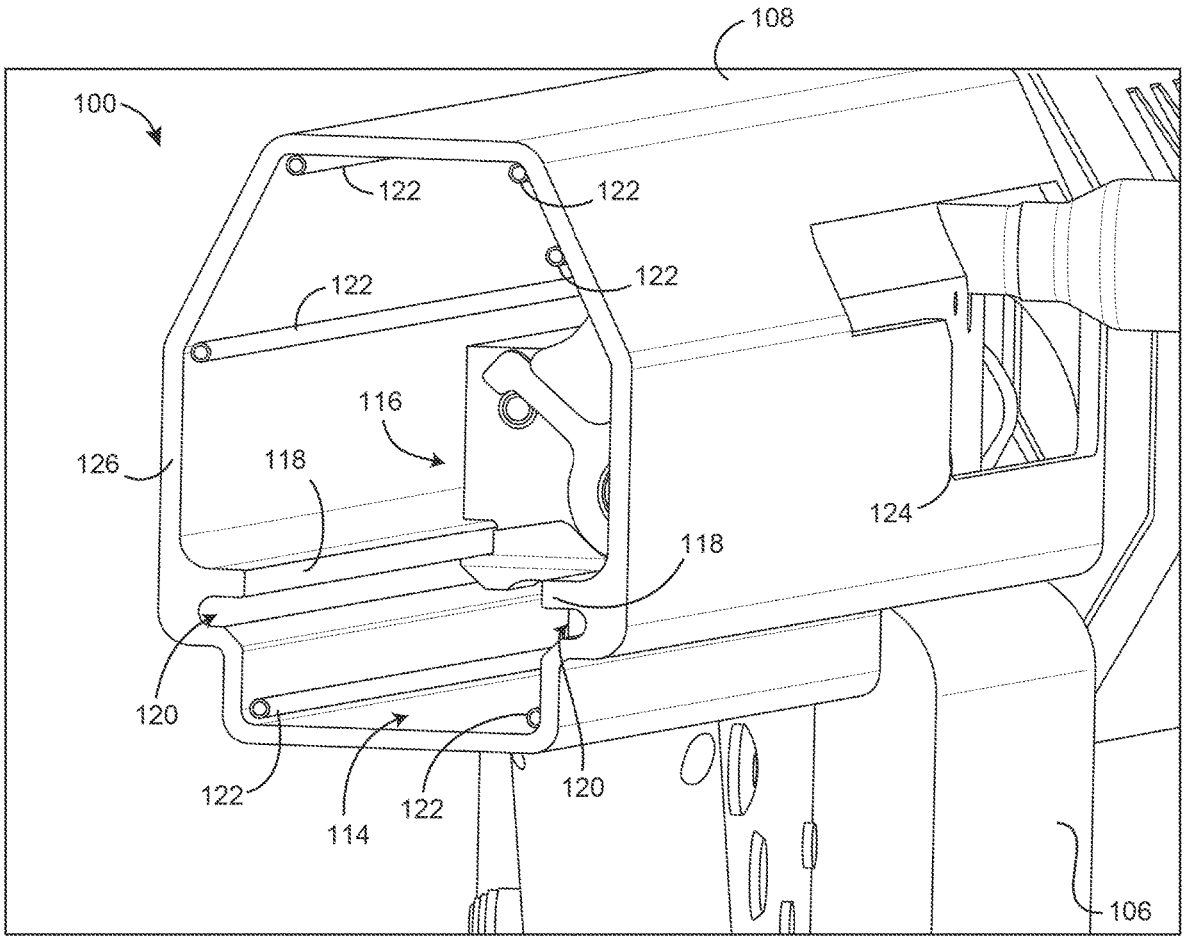
FIG. 19 is a perspective view of an interior of a receiver of the firearm of FIGS. 1-7.

Referring to FIG. 19, the upper receiver 108 is shown in greater detail, according to some embodiments. FIG. 19 shows a perspective cut-out view of the upper receiver 108. The upper receiver 108 includes an inner volume 114 (e.g., a void, an interior, a space, an internal space, etc.) that extends a length of the upper receiver 108. The upper receiver 108 includes a sidewall 126 (e.g., a shell, sides, walls, peripheries, etc.). A bolt carrier assembly 116 is positioned within the upper receiver 108 and configured to translate (e.g., reciprocatingly between two positions along the upper receiver 108) as the firearm 100 is fired.

The upper receiver 108, or more specifically, the sidewall 126 includes or defines one or more protrusions 118 (e.g., ridges, extrusions, ribs, etc.) and one or more grooves 120 (e.g., channels, kerfs, depressions, etc.) that extend lengthwise along the upper receiver 108. The protrusions 118 can extend from opposite sides of the upper receiver 108 towards each other (e.g., within the inner volume 114) and may define one or more shelves, surfaces, etc., with which the bolt carrier assembly 116 contacts, engages, slidably couples with, etc.

The upper receiver 108 also includes multiple rods 122 that extend lengthwise along the sidewalls 126 within the inner volume 114 of the upper receiver 108. In some embodiments, the rods 122 are the same as or similar to the rods 24 of the handguard 10. The rods 24 extend between a first end member of the upper receiver 108, and a second end member of the upper receiver 108 that are positioned at opposite ends of the upper receiver 108 (e.g., at opposite ends of the sidewalls 126). In some embodiments, the upper receiver 108 is configured similarly to the handguard 10 as described in greater detail above with reference to FIGS. 8-11.

The upper receiver 108 as described herein with reference to FIG. 19 may be structurally similar to the handguard 10 including rods that function similarly to the rods 24 or spokes of the handguard 10. For example, a body of the upper receiver 108 can float between end members with rods 122 extending between the end members and loaded in tension.

CONFIGURATION OF EXAMPLE EMBODIMENTS

As utilized herein, the terms "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "example" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "coupled," as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other example embodiments, and that such variations are intended to be encompassed by the present disclosure.

It is important to note that the construction and arrangement of the firearm as shown in the various example embodiments is illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. Other substitutions, modifications, changes, and omissions may be made in the design, operating conditions and arrangement of the example embodiments without departing from the scope of the present disclosure.

What is claimed is:

1. A handguard assembly for a firearm comprising:

a body member having a first end, a second end, and an inner volume, the inner volume receiving a barrel of the firearm, the body member defining a surface for a user to grasp the firearm;

a first member fixedly coupled with the body member at the first end; and a plurality of elongated members extending through the inner volume of the body member and fixedly coupled with the first member at the first end of the body member;

wherein the plurality of elongated members extend through the second end of the body member and couple with a receiver of the firearm.

2. The handguard assembly of claim 1, wherein the plurality of elongated members are rods that extend an entire length of the body member.

3. The handguard assembly of claim 1, wherein the plurality of elongated members threadingly couple with the first member.

4. The handguard assembly of claim 1, wherein the receiver further comprises a trunnion at the second end of the body member, wherein the plurality of elongated members extend into the trunnion of the receiver and are threaded into the trunnion.

5. The handguard assembly of claim 4, wherein the trunnion is fixedly coupled with the receiver of the firearm.

6. The handguard assembly of claim 1, further comprising a trunnion at the second end of the body member, wherein the plurality of elongated members are threaded into the trunnion and the trunnion is fixedly coupled with the receiver of the firearm.

7. The handguard assembly of claim 1, wherein the body member is configured to receive the barrel of the firearm and one or more components of a gas system of the firearm through the inner volume.

8. The handguard assembly of claim 1, wherein the plurality of elongated members comprise spokes.

9. The handguard assembly of claim 1, wherein the plurality of elongated members extend through the inner volume in a direction substantially parallel with a longitudinal axis defined by the body member.

10. The handguard assembly of claim 1, wherein the elongated members reduce an amount of a load applied to the body member being transferred to the barrel.

11. The handguard assembly of claim 1, wherein the plurality of elongated members comprises six elongated members.

12. A firearm comprising:

a barrel;

a receiver; and a handguard assembly comprising:

a body member having a first end, a second end, and an inner volume, the inner volume receiving the barrel of the firearm, the body member defining a portion for a user to grasp when using the firearm;

a first member fixedly coupled with the body member at the first end; and a plurality of elongated members extending through the inner volume of the body member and fixedly coupled with the first member at the first end of the body member;

wherein the plurality of elongated members extend through the second end of the body member and couple with the receiver.

13. The firearm of claim 12, wherein the plurality of elongated members are rods that extend an entire length of the body member.

14. The firearm of claim 12, further comprising a trunnion at the second end of the body member, wherein the plurality of elongated members extend through the trunnion and are threaded into the receiver of the firearm.

15. The firearm of claim 12, further comprising a trunnion at the second end of the body member, wherein the plurality of elongated members are threaded into the trunnion and the trunnion is fixedly coupled with the receiver of the firearm.

16. The firearm of claim 12, wherein the receiver comprises a plurality of spokes that extend through an inner volume of the receiver and couple at opposite ends of the receiver with end members.

17. A handguard assembly for a firearm, the handguard assembly comprising:

a body member having a first end, a second end, and an inner volume, the inner volume configured to receive a portion of the firearm, the body member defining a surface for a user to grasp the firearm; and a plurality of spokes extending through the inner volume of the body member and fixedly coupled with an end member at the first end and a receiver of the firearm at a second end, the plurality of spokes loaded in tension to provide a compressive force through the body member between the first end and the second end.

18. The handguard assembly of claim 17, wherein the plurality of spokes reduce an amount of a load applied to the body member being transferred to a barrel of the firearm.

19. The handguard assembly of claim 17, wherein the plurality of spokes extend through the inner volume in a direction substantially parallel with a longitudinal axis defined by the body member.

20. The handguard assembly of claim 17, further comprising a trunnion at the second end of the body member, wherein the plurality of spokes are fixedly coupled with the trunnion and the trunnion is fixedly coupled with the receiver of the firearm.

* * * * *